US010898742B1

(12) United States Patent
Arbuckle et al.

(10) Patent No.: US 10,898,742 B1
(45) Date of Patent: Jan. 26, 2021

(54) ADJUSTABLE BEAM ANCHOR SYSTEM

(71) Applicant: ABS Safety, LLC, Leawood, KS (US)

(72) Inventors: Blaine Craig Arbuckle, Leawood, KS (US); Brian Allen Schrader, Lone Jack, MO (US)

(73) Assignee: ABS Safety, LLC, Leawood, KS (US)

( * ) Notice: Subject to any disclaimer, the term of this patent is extended or adjusted under 35 U.S.C. 154(b) by 0 days.

(21) Appl. No.: 17/039,067

(22) Filed: Sep. 30, 2020

(51) Int. Cl.
*A62B 35/00* (2006.01)
*E04G 21/32* (2006.01)

(52) U.S. Cl.
CPC ..... *A62B 35/0068* (2013.01); *E04G 21/3276* (2013.01)

(58) Field of Classification Search
CPC ..... A62B 35/0068; E04G 21/3276
See application file for complete search history.

(56) References Cited

U.S. PATENT DOCUMENTS 947,441 A * 1/1910 Hankins
5,092,426 A * 3/1992 Rhodes ..... A62B 35/0068 182/3
5,346,036 A * 9/1994 Arisman ..... A62B 35/04 182/3
5,711,397 A 1/1998 Flora
6,053,279 A * 4/2000 McKenna ..... A62B 35/0081 182/3
6,691,827 B2 * 2/2004 Lycett ..... A62B 35/0068 182/138
6,962,234 B1 11/2005 Reeves
8,312,966 B1 * 11/2012 Guthrie ..... A62B 35/0081 182/36
9,216,307 B2 * 12/2015 Liu ..... E04G 21/3276
9,611,664 B2 * 4/2017 Tsaousis ..... E04G 21/3242
2007/0163834 A1 * 7/2007 Casebolt ..... A62B 35/0068 182/3

* cited by examiner

*Primary Examiner* — Alvin C Chin-Shue
(74) *Attorney, Agent, or Firm* — Mashburn Law Office, LLC; Donna Denise Masbburn Chapman

(57) ABSTRACT

An adjustable beam anchor system comprising a first elongated bar member having a plurality of longitudinally-spaced apertures, an attachment system, a first pivot system, a second pivot system, and a second elongated bar member having a plurality of apertures. The attachment system comprises a saddle and a connector ring. The first pivot system broadly comprising a first coupling unit, a first pivot unit, and a first ball bearing pin, wherein the first pivot system may rotate or pivot around the first elongated bar member. The second pivot system comprising a second coupling unit, a second pivot unit, and a second ball bearing pin, wherein the second pivot system may rotate or pivot around the first elongated bar member. The second elongated bar member comprising a plurality of apertures and an anchor foot, wherein the second elongated bar member may rotate or pivot around the second coupling unit.

20 Claims, 7 Drawing Sheets

ADJUSTABLE BEAM ANCHOR SYSTEM

BACKGROUND

Embodiments of the present invention relate generally to the field of anchorage safety devices that function to secure and arrest a construction worker against a fall from an elevated height. For example, steelworkers secure an anchorage device to a steel beam when working at elevated heights. The worker attaches one end of a fall arrest connector, e.g., a lanyard, self-retracting lifeline, etc., to the anchorage device and the opposite end of the fall arrest connector is attached to a body harness worn by the worker.

SUMMARY

The present invention is an adjustable beam anchor system that is slidably secured to a flanged steel beam to permit freedom of movement for a worker. The adjustable beam anchor system may be securely mounted at various angles to all sizes, dimensions, and configurations of steel beams, including but not limited to, S beams with tapered flanges, wide flange H beams, and I-beams having a structural steel angle or a steel channel welded thereto.

The adjustable beam anchor system broadly comprises a first elongated bar member having a plurality of longitudinally-spaced apertures, an attachment system, a first pivot system, a second pivot system, and a second elongated bar member having a plurality of longitudinally spaced apertures. The attachment system may include a saddle and a ring that are coupled and slidably mounted to the first elongated bar member. The first pivot system may be slidably attached near a first end of the first elongated bar member and may include a first coupling unit, a first pivot unit, and a first ball bearing pin. The first pivot system may rotate or pivot around the first elongated bar member. The second pivot system may be pivotably attached near the second end of the first elongated bar member and pivotably attached to the longitudinally-spaced apertures of the second elongated bar member. The second pivot system includes a second coupling unit, a second pivot unit, and a second ball bearing pin. The second pivot system may rotate or pivot around the first elongated bar member. The second elongated bar member may include a plurality of longitudinally-spaced apertures and an anchor foot. The second elongated bar member may rotate or pivot around the second coupling unit.

The above-described adjustable beam anchor system 10 provides numerous advantages over the prior art. For example, the adjustable beam anchor system may be pivotably attached to any size, shape, or configuration of an I-beam. In addition, the adjustable beam anchor system may be mounted at numerous angles to an I-beam having a structural steel angle, e.g., a pour stop, angle iron, bent plate, or other similar structure. This range of attachment angles is achieved by the novel combination of pivotal structures, i.e., the first elongated bar member, the first pivot system, the second pivot system, and the second elongated bar member.

This summary is provided to introduce a selection of concepts in a simplified form that are further described in the detailed description below. The summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
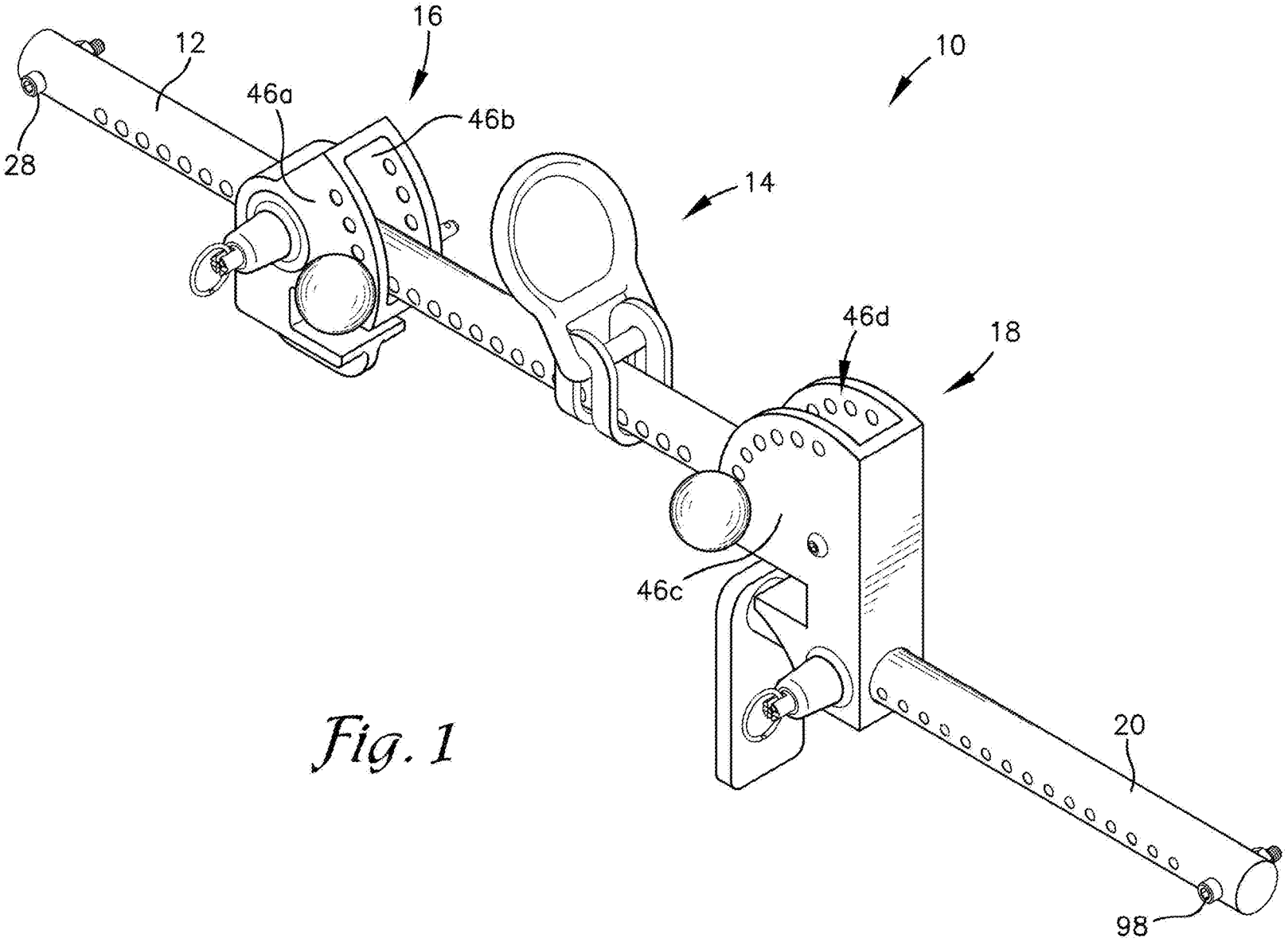
FIG. 1 is a perspective view of an adjustable beam anchor system, constructed in accordance with an embodiment of the present invention.
Figure 5A:
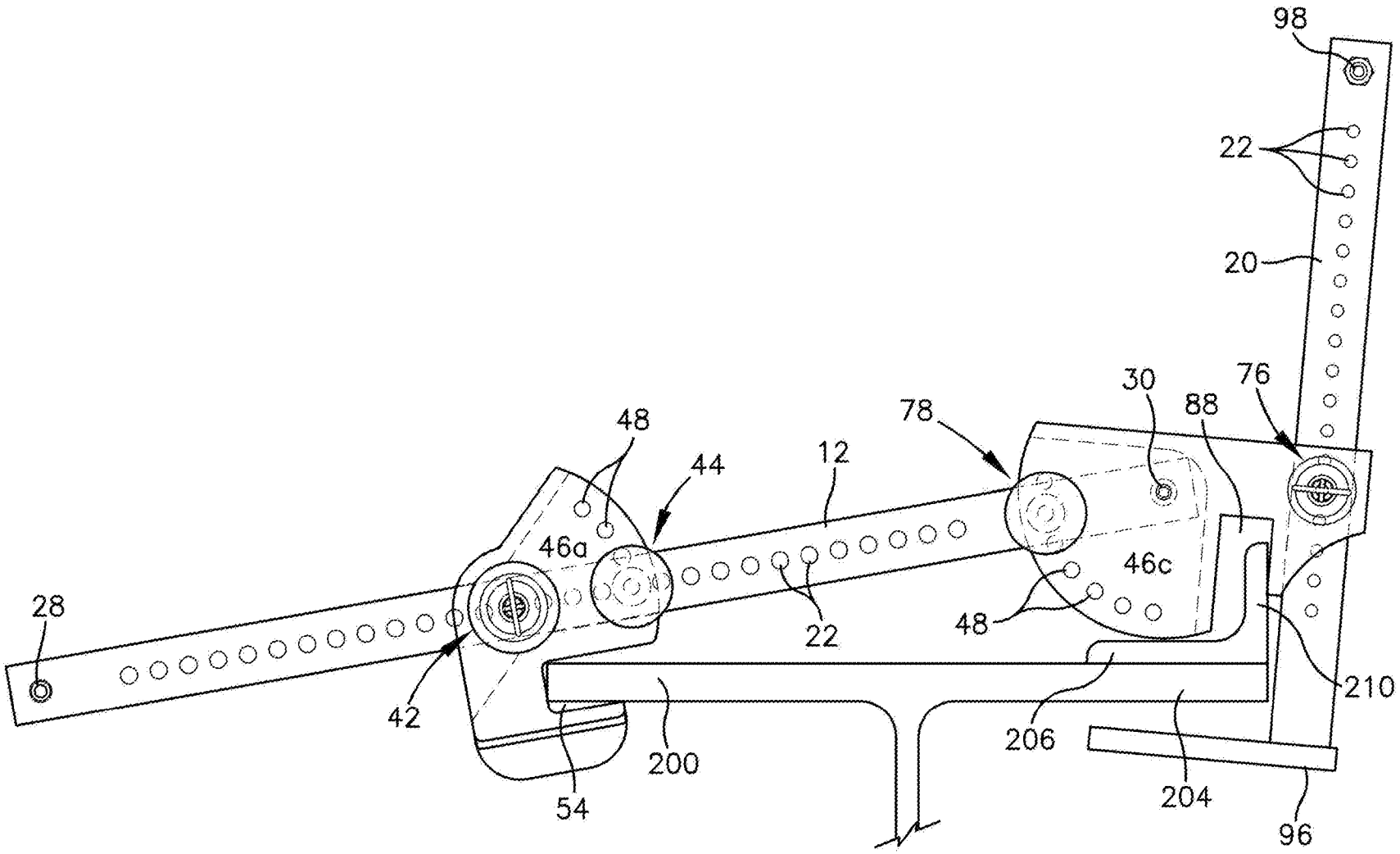
Figure 5B:
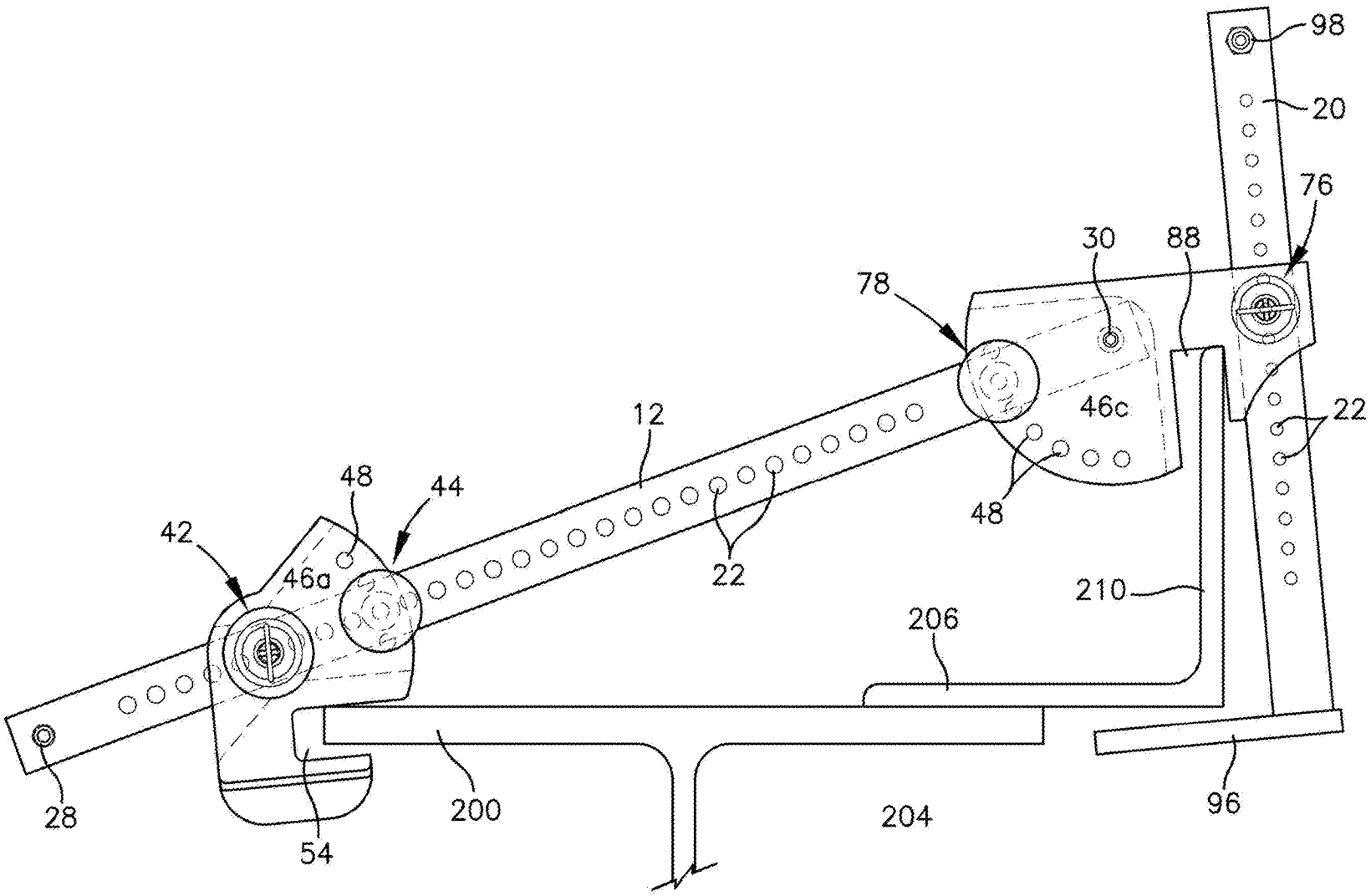
Figure 5C:
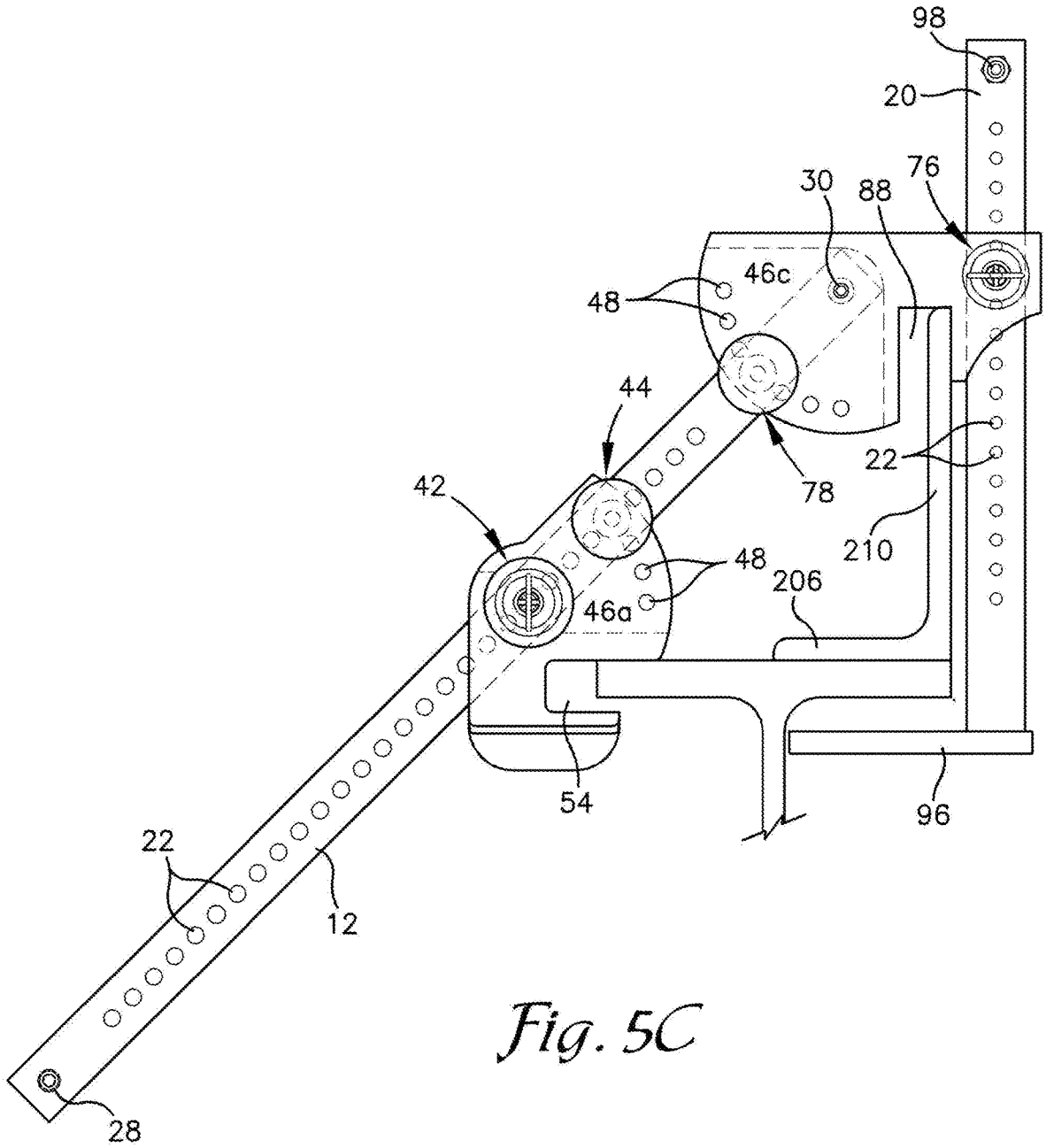

FIG. 5*a* is a side view showing the adjustable beam anchor system of FIG. 1 mounted at a 10-degree angle to an I-beam having a structural steel angle, constructed in accordance with an embodiment of the present invention;

FIG. 5*b* is a side view showing the adjustable beam anchor system of FIG. 1 mounted at a 20-degree angle to an I-beam having a structural steel angle, constructed in accordance with an embodiment of the present invention; and FIG. 5*c* is a side view showing the adjustable beam anchor system of FIG. 1 mounted at a 45-degree angle to an I-beam having a structural steel angle, constructed in accordance with an embodiment of the present invention.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning to FIGS. 1-5, an adjustable beam anchor system 10 constructed in accordance with an embodiment of the present invention is illustrated. The adjustable beam anchor system 10 broadly includes a first elongated bar member 12, an attachment system 14, a first pivot system 16, a second pivot system 18, and a second elongated bar member 20. The various components of the first elongated bar member 12, the attachment system 14, the first pivot system 16, the second pivot system 18, and the second elongated bar member 20 may be formed of steel, tempered aluminum, or any other suitable durable metal material, metal alloy, or combination of durable materials.

Figure 2:
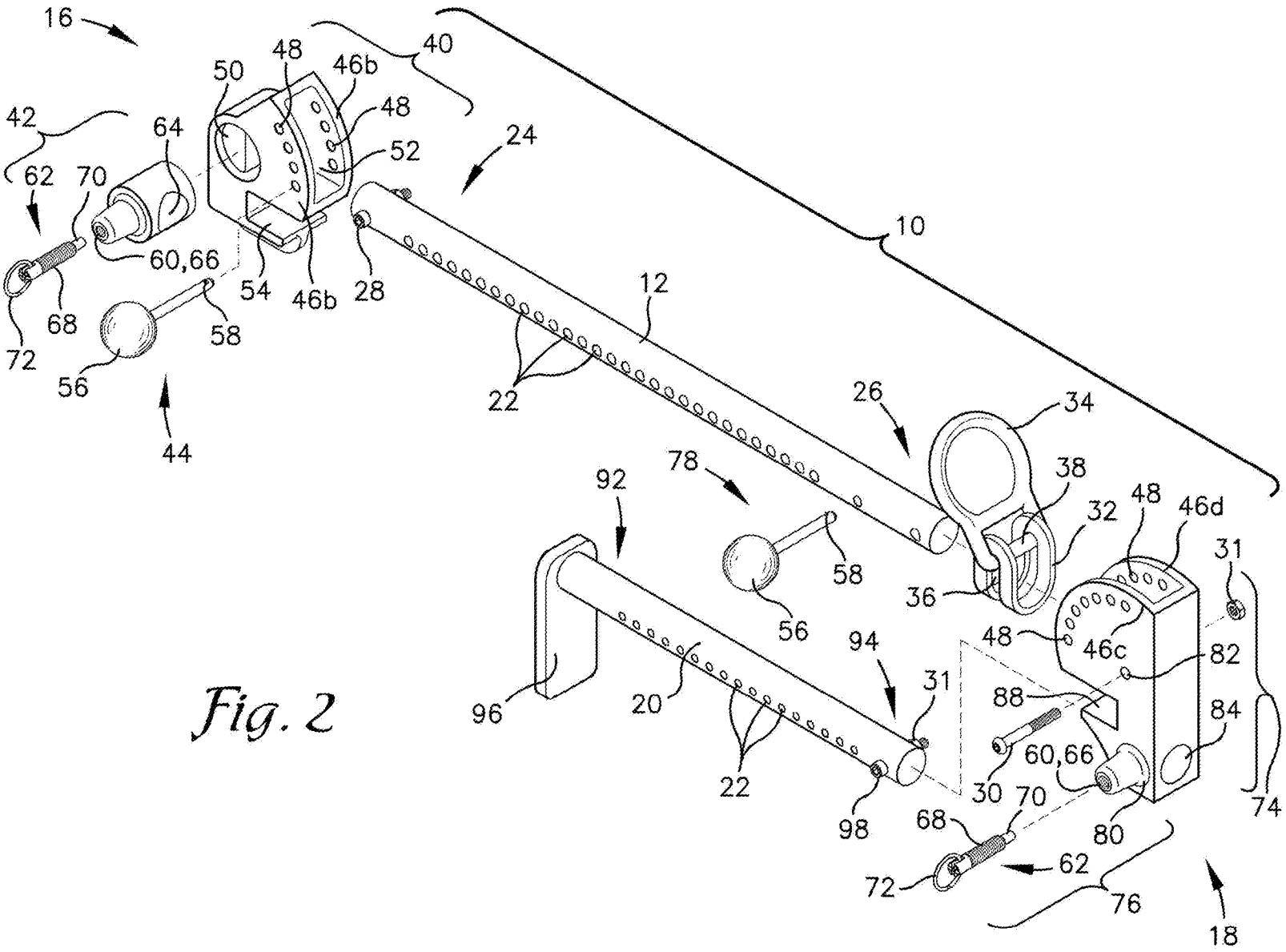
FIG. 2 is an exploded view of the adjustable beam anchor system of FIG. 1, constructed in accordance with an embodiment of the present invention.
Figure 3:
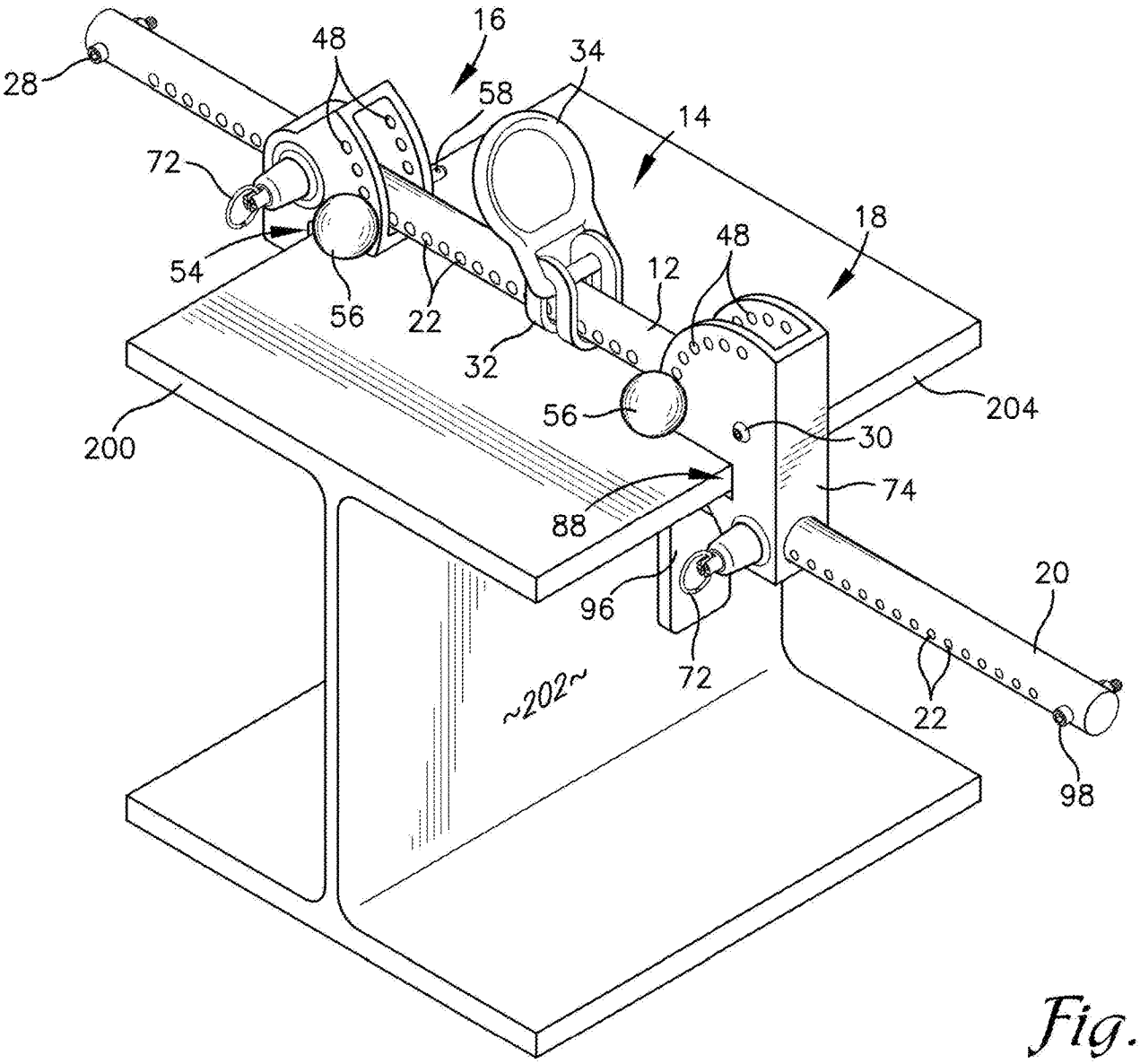
FIG. 3 is a perspective view of the adjustable beam anchor system of FIG. 1 attached to an I-beam, constructed in accordance with an embodiment of the present invention.

The first elongated bar member 12 may be a solid bar having a plurality of apertures 22 along its longitudinal axis, a first end 24, and a second end 26. The shape of the first elongated bar member 12 may vary. For example, as shown in FIGS. 1-3, the first elongated bar member 12 may be cylindrical. In another embodiment, the first elongated bar member 12 may have one or more flattened sides. The one or more flattened sides of the first elongated bar member 12 may restrict the pivoting or rotational movement of the first pivot system 16 around the first elongated bar member 12. A first end stop bolt 28, e.g., a bolt, screw, or other fastener, may be inserted through an aperture 22 located near the first end 24 of the first elongated bar member 12 and secured with a nut 31, clamp, clasp, or any other type of interlocking geometry. The first end stop bolt 28 prevents the first pivot system 16 from sliding off of the first end 24 of the first elongated bar member 12. Similarly, a second end stop bolt 30 may be inserted through and secured to an aperture 22 located near the second end 26 of the first elongated bar member 12 to prevent the second pivot system 18 from sliding off of the second end 26 of the first elongated bar member 12.

The attachment system 14 broadly includes a saddle 32 and a connector ring 34. The attachment system 14 may be located along the first elongated bar member 12 between the first pivot system 16 and the second pivot system 18. The saddle 32 has a generally curved shape that partially surrounds the first elongated bar member 12 and includes one or more openings 36 for connector ring 34 attachment. The shape, number, and size of the openings in the saddle 32 may vary. In one embodiment, as best illustrated in FIG. 2, the opening 36 in the saddle 32 is a single, curved slot. In another embodiment, the saddle 32 may include two or more circular openings 36 for connector ring 34 attachment. The connector ring 34 may be a D-ring, O-ring, V-ring, or any similar metal ring for attaching one end of a lanyard thereto. In one embodiment, the connector ring 34 may directly be attached to the saddle 32 through the opening 36. In another embodiment, as shown in FIG. 1, the connector ring 34 may include a cross bar 38 for attaching the connector ring 34 to the saddle 32. In this embodiment, the cross bar 38 of the connector ring 34 passes through the opening 36 of the saddle 32 above the first elongated bar member 12 thereby slidably securing the saddle 32 to the first elongated bar member 12 and simultaneously attaching the connector ring 34 to the saddle 32.

The first pivot system 16 may be pivotably attached to an aperture 22 near the first end 24 of the first elongated bar member 12. The apertures 22 along the first elongated bar member 12 allow a worker to slide the first pivot system 16 and reattach it to the first elongated bar member 12 at various points. The first pivot system 16 broadly includes a first coupling unit 40, a first pivot unit 42, and a first ball bearing pin 44. As best shown in FIG. 2, the first coupling unit 40 broadly includes two sides 46*a*, 46*b* having a plurality of holes 48 for receiving the first ball bearing pin 44, a first orifice 50 for receiving the first pivot unit 42, a second orifice 52 for receiving the first elongated bar member 12, and a first open-ended cavity 54 for receiving the flange 200 of a beam 202. The two sides 46*a*, 46*b* of the first coupling unit 40 extend outward along the first elongated bar member 12. In one embodiment, as shown in FIGS. 1-5, the two sides 46*a*, 46*b* of the first coupling unit 40 have a curved shape. It will be readily apparent to those skilled in the art that the shape and dimensions of the two sides 46*a*, 46*b* may vary.

The first ball bearing pin 44 may be an elongated cylindrical member that includes a head 56 at one end and an outwardly biased ball bearing 58 near the opposite end. The first pivot system 16 may be locked into position by pushing the biased ball bearing 58 through a hole 48 in side 46*a* of the first coupling unit 40, through an aperture 22 of the first elongated bar member 12, and through a hole 48 in side 46*b* of the first coupling unit 40. The diameters of the plurality of holes 48 in the two sides 46*a*, 46*b* and the apertures 22 are configured to push against the ball bearing 58 so as to overcome the biasing force until the ball bearing 58 is sufficiently urged from a deployed position to an retracted position such that the first ball bearing pin 44 is pushed through the holes 48 and the aperture 22. The head 56 and the deployed biased ball bearing 58 of the first ball bearing pin 44 lock the first coupling unit 40 to the first elongated bar member 12 at a desired location and angle.

The first pivot unit 42 broadly includes a quick-release passage 60, a quick-release fastener 62 (e.g., a pull pin, spring plunger, or similar fastener), and a first elongated bar member passage 64. The first pivot unit 42 may rotate within the first orifice 50 of the first coupling unit 40. The first pivot unit 42 may partially extend outwardly from the first orifice 50 and may partially extend inside the first orifice 50. The first elongated bar member passage 64 of the first pivot unit 42 may be positioned inside the second orifice 52 of the first coupling unit 40.

The shape of the first elongated bar member passage 64 may vary. For example, as best seen in FIG. 2, the first elongated bar member passage 64 may be cylindrical. In another embodiment, the first elongated bar member passage 64 may have one or more flattened sides. The one or more flattened sides of the first elongated bar member passage 64 may restrict the pivoting or rotational movement of the first pivot system 16 around the first elongated bar member 12.

The quick-release passage 60 receives the quick-release fastener 62 and may include internal threads 66. The quick release fastener 62 may be an elongated cylindrical member that includes external threads 68, a biased pin 70, and a fastener ring 72. The biased pin 70 may be retracted inside the quick release fastener 62 by pulling on the fastener ring 72. During use, a worker may remove the first ball bearing pin 44, pull on the fastener ring 72 to retract the biased pin 70, slide the first pivot system 16 to a different location along the first elongated bar member 12, and release the fastener ring 72 thereby reattaching the quick-release fastener 62 to a different aperture 22 on the first elongated bar member 12. The first coupling unit 40 is then pivoted or rotated to the desired angle and the first ball bearing pin 44 is reinserted to maintain the angle and position.

The first pivot system 16 may be assembled and simultaneously attached near the first end 24 of the first elongated bar member 12. First, the first pivot unit 42 is inserted into the first orifice 50 of the first coupling unit 40. The first elongated bar member passage 64 of the first pivot unit 42 is aligned with the second orifice 52 of the first coupling unit 40. After alignment, the first end 24 of the first elongated bar member 12 may be inserted simultaneously through the first elongated bar member passage 64 and the second orifice 52. The quick-release fastener 62 may be rotatably inserted into the quick-release passage 60 with the biased pin 70 extending through an aperture 22 on the first elongated bar member 12. The first end stop bolt 28 is attached to an aperture 22 near the first end 24 of the first elongated bar member 12 to prevent the first pivot system 16 from sliding off of the first end 24. The assembled first coupling unit 40 may pivot or rotate around the first pivot unit 42 to the desired position and the first ball bearing pin 44 may be inserted through an aperture 22 on the first elongated bar member 12.

The second pivot system 18 may be assembled and pivotably attached to the second end 26 of the first elongated bar member 12. The second pivot system 18 broadly includes a second coupling unit 74, a second pivot unit 76, and a second ball bearing pin 78. As best shown in FIG. 2, the second coupling unit 74 broadly includes two sides 46*c*, 46*d* having a plurality of holes 48 for receiving the second ball bearing pin 78, a first orifice 80 for attaching the second pivot unit 76 thereto, a second orifice 82 for receiving the second end stop bolt 30, a third orifice 84 for receiving a second elongated bar member 20, and a second open-ended cavity 88 for receiving the flange 204 of a beam 202. The two sides 46*c*, 46*d* of the second coupling unit 74 extend outward along the second end 26 of the first elongated bar member 12. In one embodiment, as shown in FIGS. 1-5, the two sides 46*c*, 46*d* of the second coupling unit 74 have a curved shape. It will be readily apparent to those skilled in the art that the shape and dimensions of the two sides 46*c*, 4*db* may vary.

The second ball bearing pin 78 may be an elongated cylindrical member that includes a head 56 and an outwardly biased ball bearing 58. As explained above, the biased ball bearing 58 is urged inside the second ball bearing pin 78 as it passes through aligned holes 48 of the second coupling unit 74 and an aperture 22 near the second end 26 of the first elongated bar member 12. The head 56 and the extended biased ball bearing 58 of the second ball bearing pin 78 lock the second coupling unit 74 at a desired angle.

The second end stop bolt 30 attaches the second pivot system 18 to the second end 26 of the first elongated bar member 12. To attach, the second end stop bolt 30 may be inserted through the second orifice 82 of the second coupling unit 74 and through an aperture 22 on second end 26 of the first elongated bar member 12. A nut 31, clamp, clasp, or any other type of interlocking geometry may be used to secure the second end stop bolt 30 in position. During use, a worker may pivot the second pivot system 18 around the second end stop bolt 30 to position the second open-ended cavity 88 of the second coupling unit 74 at a desired angle. The second ball bearing pin 78 may be inserted into an aperture 22 on the first elongated bar member 12 to maintain the angle of the second coupling unit 74 for beam attachment.

The second pivot unit 76 may extend outwardly from and may be attached to the first orifice 80 of the second pivot system 18. The second pivot unit 76 broadly includes a quick-release passage 60 and a quick-release fastener 62 (e.g., a pull pin, spring plunger, or similar fastener). The quick-release passage 60 receives the quick-release fastener 62 and may include internal threads 66. The quick release fastener 62 may be an elongated cylindrical member that includes external threads 68, a biased pin 70, and a fastener ring 72. The biased pin 70 may be retracted inside the quick release fastener 62 by pulling on the faster ring 72.

The second pivot unit 76 slidably attaches the second pivot system 18 to the second elongated bar member 20. The second elongated bar member 20 may be a solid bar having a plurality of apertures 22 along its longitudinal axis, a first end 92, a second end 94, and an anchor foot 96. The third orifice 84 may receive the second elongated bar member 20 therethrough. The quick-release fastener 62 may be inserted through the quick-release passage 60 and through an aperture 22 located along the second elongated bar member 20, thereby pivotably attaching the second pivot unit 76 to the second elongated bar member 20. A second end stop bolt 98 may be attached to an aperture 22 located near the second end 94 of the second elongated bar member 20 to prevent the second pivot system 18 from sliding off. A nut 31, clamp, clasp, or any other type of interlocking geometry may be used to secure the second end stop bolt 98 in position.

Figure 4:
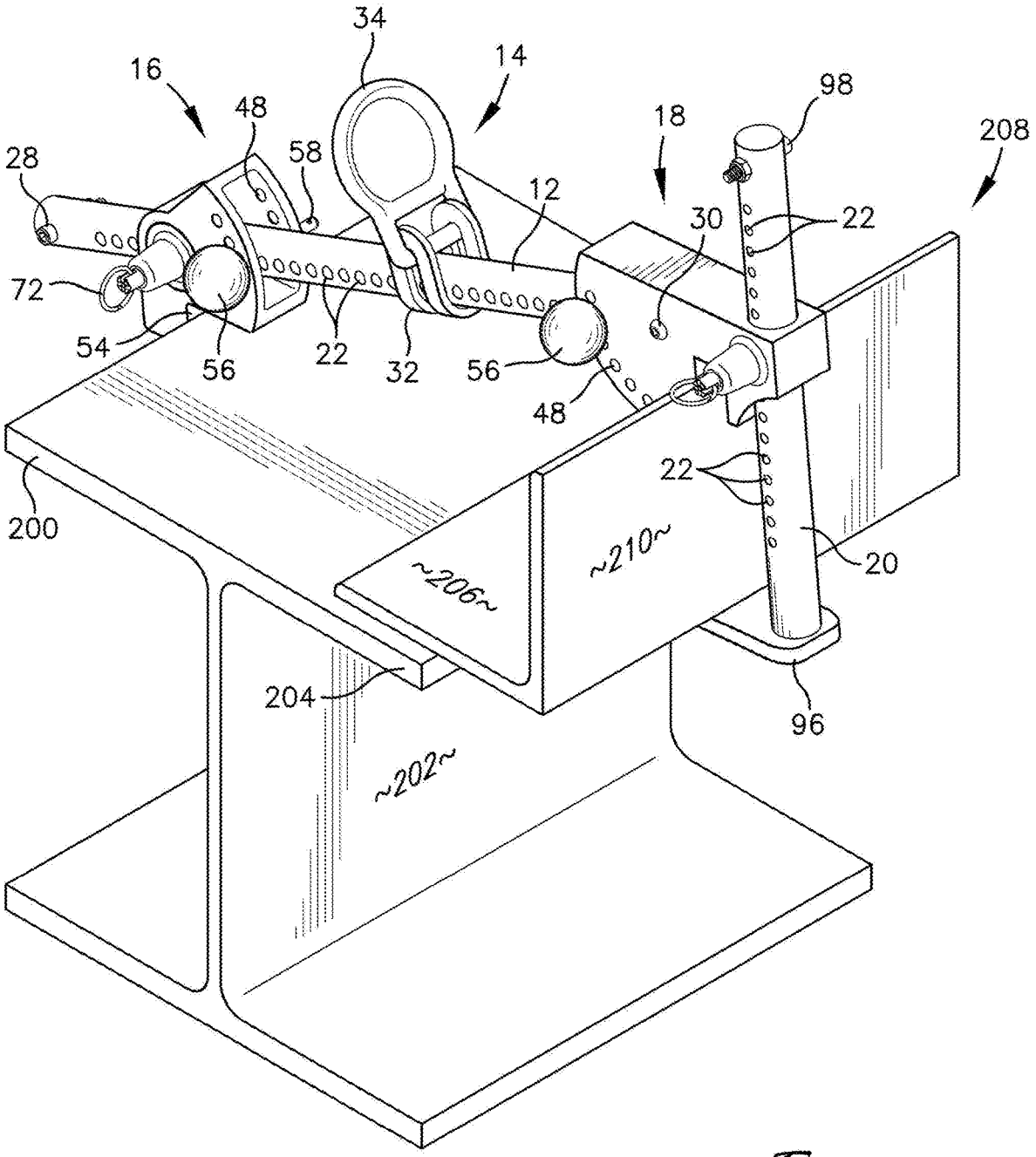
FIG. 4 is a perspective view of the adjustable beam anchor system of FIG. 1 attached to an I-beam having a structural steel angle, constructed in accordance with an embodiment of the present invention.

The anchor foot 96 may be a generally planar structure that extends from and may be securely attached to the first end 92 of the second elongated bar member 20. As shown in FIG. 4, the anchor foot 96 may be attached to the second elongated bar member 20 at a 45-degree angle. Those skilled in the art will understand that the anchor foot 96 may be attached to the second elongated bar member 20 at other angles without departing from the scope of the invention. In one embodiment, the anchor foot 96 may be removably attached to the first end 92 of the second elongated bar member 20. In another embodiment, the anchor foot 96 and the first end 92 of the second elongated bar member 20 may be welded together, held together by fasteners or adhesives, or unitarily formed out a single piece of metal. The shape and size of the anchor foot 96 may vary. In one embodiment, as shown in FIG. 3, the anchor foot 96 may be positioned beneath the flange 204 of an I-beam 202 to firmly attach the second pivot system 18 to the flange 204. In another embodiment, as shown in FIGS. 4, 5*a*, 5*b*, and 5*c*, the anchor foot 96 may be positioned beneath the horizontal plate 206 of a structural steel angle 208 to firmly rotate and attach the second pivot system 18 at different angles to an I-beam 202 having a structural steel angle 208. Structural steel angles 208 broadly include pour stops, angle irons, bent plates, and other similar structures.

Turning now to FIG. 3, the use of the fully assembled adjustable beam anchor system 10 will now be described in more detail. For example, to mount the adjustable beam anchor system 10 on an I-beam 202, the worker first couples one flange 204 of the I-beam 202 with the second open-ended cavity 88 of the second coupling unit 74. The second ball bearing pin 78 of the second pivot system 18 may be removed to pivot or rotate the second pivot system 18 and to position the flange 204 securely in the second open-ended cavity 88 of the second coupling unit 74. The second ball bearing pin 78 may be reinserted through holes 48 in the two sides 46*c*,46*d* of the second coupling unit 74 and an aperture 22 of the first elongated bar member 12 to maintain the desired angle and position of the second pivot system 18. Second, the worker adjusts the distance between the first pivot system 16 and the second pivot system 18, i.e., the worker slides the first pivot system 16 closer to or away from the second pivot system 18. The first ball bearing pin 44 is removed from the first pivot system 16 and the quick-release fastener 62 is disengaged by pulling the fastener ring 72 outward from the first pivot unit 42. While pulling the fastener ring 72, the worker slides the first pivot system 16 along the first elongated bar member 12 to the desired position on the opposite side of the I-beam 202. Third, the worker couples the first open-ended cavity 54 of the first coupling unit 40 to a flange 200 located on the opposite side of the I-beam 202. The fastener ring 72 is released, thereby reattaching the first pivot unit 72 to an aperture 22 in the first elongated bar member 12. The first coupling unit 40 may be pivoted or rotated around the first pivot unit 42 to allow the worker to couple the flange 200 on the opposite side of the I-beam 202 with the first open-ended cavity 54 of the first coupling unit 40. The first ball bearing pin 44 may be reinserted through holes 48 in the two sides 46*a*,46*b* of the first coupling unit 40 and an aperture 22 of the first elongated bar member 12 to maintain the angle and position of the first open-ended cavity 54, thereby securely anchoring the adjustable beam anchor system 10 to the I-beam 202. Lastly, the worker may attach one end of a fall arrest connector, e.g., a lanyard, self-retracting lifeline, etc., to the connector ring 34 and the opposite end of the fall arrest connector may be attached to a body harness worn by the worker.

As shown in FIGS. 4, 5*a*, 5*b*, and 5*c*, the adjustable beam anchor system 10 may also be securely attached at different angles to an I-beam 202 that has a structural steel angle 208. To more clearly illustrate the angular mounting configurations, the adjustable beam anchor system 10 shown in FIGS. 5*a*, 5*b*, and 5*c* does not include the attachment system 14. In FIG. 5*a* the present invention is shown mounted at a ten-degree angle, in FIG. 5*b* the present invention is shown mounted at a 20-degree angle, and in FIG. 5*c* the present invention is shown mounted at a 45-degree angle to an I-beam 202 having a structural steel angle 208. It will be readily apparent to those skilled in the art that the adjustable beam anchor system 10 may be pivotably positioned and mounted at additional angles depending on the size, shape, and configuration of the I-beam 202 and the structural steel angle 208.

To securely mount the adjustable beam anchor system 10 to an I-beam 202 having a structural steel angle 208, the worker first securely mounts the second pivot system 18 and the anchor foot 96 to the structural steel angle 208. The anchor foot 96 of the second elongated bar member 20 is positioned below the horizontal plate 206 of the structural steel angle 208. The fastener ring 72 of the second pivot unit 76 is pulled outward to permit the second pivot system 18 to be raised or lowered along the second elongated bar member 20 to a height needed to couple the second open-ended cavity 88 of the second coupling unit 74 with the vertical plate 210 of the structural steel angle 208. The second ball bearing pin 78 may be removed from the second pivot system 18 to pivot or rotate the second pivot system 18 and to securely position the vertical plate 210 of the structural steel angle 208 in the second open-ended cavity 88. The second ball bearing pin 78 may be reinserted through holes 48 in the two sides 46*c*,46*d* of the second coupling unit 74 and an aperture 22 of the first elongated bar member 12 to maintain the position of the second pivot system. Second, the worker adjusts the distance between the first pivot system 16 and the second pivot system 18. The first ball bearing pin 44 is removed from the first pivot system 16 and the quick-release fastener 62 is disengaged by pulling the fastener ring 72 outward from the first pivot unit 42. While pulling the fastener ring 72, the worker slides the first pivot system 16 along the first elongated bar member 12 to the desired position on the opposite side of the I-beam 202. Third, the worker couples the first open-ended cavity 54 of the first coupling unit 40 to a flange 200 located on the I-beam 202. The fastener ring 72 of the quick-release fastener 62 is released, thereby reattaching the first pivot unit 42 to an aperture 22 on the first elongated bar member 12. The first coupling unit 40 may be pivoted to allow the worker to position the flange 200 of the I-beam 202 securely in the first open-ended cavity 54 of the first coupling unit 40. The first ball bearing pin 44 may be reinserted through holes 48 in the two sides 46*a*, 46*b* of the first coupling unit 40 and an aperture 22 of the first elongated bar member 12 to maintain the position of the first pivot system 16, thereby securely anchoring the adjustable beam anchor system 10 an I-beam 202 having a structural steel angle 208. Lastly, the worker may attach one end of a fall arrest connector, e.g., a lanyard, self-retracting lifeline, etc., to the connector ring 34 and the opposite end of the fall arrest connector may be attached to a body harness worn by the worker.

The shape, size, and configuration of the first open-ended cavity 54 and the second open-ended cavity 88 may vary. For example, the first open-ended cavity 54 and the second open-ended cavity 88 may be C-shaped, D-shaped, U-shaped, or any other desirable shape.

In one embodiment, the first open-ended cavity 54, the second open-ended cavity 88, and the anchor foot 96 may have rounded edges, a non-stick coating, and/or padding to reduce friction as the adjustable beam anchor system 10 glides along a beam 202 during use. Examples of non-stick surface coatings include Teflon, cephalon, silicone, enamel, or any other non-stick material or combination of non-stick materials. The non-stick surface coating permits the adjustable beam anchor system 10 to move and slide freely along the beam, which improves worker mobility.

In another embodiment, the attachment system 14 may be attached to an aperture 22 along the first elongated bar member 12 to prevent the attachment system 14 from sliding. For example, a bolt, screw, or other type of fastener may be simultaneously inserted through one or more openings 36 in the saddle 32 and through an aperture 22 on the first elongated bar member 12 to fasten the attachment system 14 at a fixed position. A nut 31, clamp, clasp, or any other type of interlocking geometry may be used to secure the fastener.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. An adjustable beam anchor system comprising:

a first elongated bar member having a plurality of longitudinally-spaced apertures;

an attachment system comprising:

a saddle; and a connector ring, wherein the saddle and connector ring are coupled to the first elongated bar member;

a first pivot system comprising:

a first coupling unit;

a first pivot unit; and a first ball bearing pin, wherein the first pivot system can rotate or pivot around the first elongated bar member;

a second pivot system comprising:

a second coupling unit;

a second pivot unit; and a second ball bearing pin, wherein the second pivot system can rotate or pivot around the first elongated bar member;

a second elongated bar member comprising:

a plurality of longitudinally-spaced apertures; and an anchor foot, wherein the second elongated bar member can rotate or pivot around the second coupling unit.

2. The adjustable beam anchor system of claim 1, wherein the first elongated bar member includes a first stop end bolt and a second stop end bolt.

3. The adjustable beam anchor system of claim 1, wherein the saddle of the attachment system includes one or more openings for connector ring attachment.

4. The adjustable beam anchor system of claim 3, wherein the one or more openings of the saddle is a curved slot.

5. The adjustable beam anchor system of claim 1, wherein the first coupling unit includes two sides having a plurality of holes for receiving the first ball bearing pin, a first orifice for receiving the first pivot unit, a second orifice for receiving the first elongated bar member, and a first open-ended cavity for receiving a flange of an I-beam.

6. The adjustable beam anchor system of claim 2, wherein the second coupling unit includes two sides having a plurality of holes for receiving the second ball bearing pin, a first orifice for receiving the second pivot unit, a second orifice for receiving the second end stop bolt, a third orifice for receiving the second elongated bar member, and a second open-ended cavity for receiving a flange of an I-beam or the vertical plate of a structural steel angle.

7. The adjustable beam anchor system of claim 5, wherein the first pivot unit includes a quick-release passage, a quick-release fastener, and a first elongated bar member passage.

8. The adjustable beam anchor system of claim 2, wherein the second pivot unit includes a quick-release passage and a quick-release fastener.

9. The adjustable beam anchor system of claim 7, wherein the first elongated bar member passage of the first pivot unit is aligned with the second orifice of the first coupling unit.

10. The adjustable beam anchor system of claim 8, wherein the quick-release passage of the second pivot unit and an aperture of the second elongated bar member are aligned to receive the quick-release fastener therethrough.

11. The adjustable beam anchor system of claim 10, wherein the second elongated bar includes the anchor foot.

12. The adjustable beam anchor system of claim 9, wherein the first elongated bar member passes through the first elongated passage and the second orifice.

13. The adjustable beam anchor system of claim 11, wherein the second elongated bar member passes through a third orifice and a second elongated bar member passage.

14. An adjustable beam anchor system comprising:

a first elongated bar member having a plurality of longitudinally-spaced apertures;

an attachment system comprising:

a saddle; and a connector ring, wherein the saddle and connector ring are coupled to the first elongated bar member;

a first pivot system comprising:

a first coupling unit, wherein the first coupling unit includes two sides having a plurality of holes for receiving a first ball bearing pin;

a first pivot unit; and a first ball bearing pin, wherein the first pivot system can rotate or pivot around the first elongated bar member;

a second pivot system comprising:

a second coupling unit, wherein the second coupling unit includes two sides having a plurality of holes for receiving a second ball bearing pin;

a second pivot unit; and a second ball bearing pin, wherein the second pivot system can rotate or pivot around the first elongated bar member;

a second elongated bar member comprising:

a plurality of longitudinally-spaced apertures; and an anchor foot, wherein the second elongated bar member can rotate or pivot around the second coupling unit.

15. The adjustable beam anchor system of claim 14, wherein the adjustable beam anchor system may be mounted at a 10-degree angle to an I-beam having a structural steel angle.

16. The adjustable beam anchor system of claim 14, wherein the adjustable beam anchor system may be mounted at a 20-degree angle to an I-beam having a structural steel angle.

17. The adjustable beam anchor system of claim 14 wherein the adjustable beam anchor system may be mounted at a 45-degree angle to an I-beam having a structural steel angle.

18. The adjustable beam anchor system of claim 14, wherein the second pivot unit pivotably attaches the second elongated bar member to the second pivot system.

19. The adjustable beam anchor system of claim 14, further includes a second end stop bolt that pivotably attaches the second pivot system to the first elongated bar member.

20. An adjustable beam anchor system comprising:

a first elongated bar member having a plurality of longitudinally-spaced apertures;

an attachment system comprising:

a saddle; and a connector ring, wherein the saddle and connector ring are coupled to the first elongated bar member;

a first pivot system comprising:

a first coupling unit, wherein the first coupling unit includes two sides having a plurality of holes for receiving a first ball bearing pin;

a first pivot unit comprising:

a quick-release passage;

a quick-release fastener; and a first elongated bar member passage; and a first ball bearing pin, wherein the first pivot system can rotate or pivot around the first elongated bar member;

a second pivot system comprising:

a second coupling unit, wherein the second coupling unit includes two sides having a plurality of hoes for receiving a second ball bearing pin;

a second pivot unit comprising:

a quick-release passage;

a quick-release fastener; and a second elongated bar member passage; and a second ball bearing pin, wherein the second pivot system can rotate or pivot around the first elongated bar member;

a second elongated bar member comprising:

a plurality of longitudinally-spaced apertures; and an anchor foot, wherein the second elongated bar member can rotate or pivot around the second coupling unit.

* * * * *